US010584480B2

(12) United States Patent
Charles et al.

(10) Patent No.: US 10,584,480 B2
(45) Date of Patent: Mar. 10, 2020

(54) STAIR EXPANSION JOINT SYSTEM WITH FREEDOM OF MOVEMENT BETWEEN LANDINGS

(71) Applicant: EMEH, INC., Lebanon, NJ (US)

(72) Inventors: Bryan I. Charles, Muncy, PA (US); Roger W. Barr, Williamsport, PA (US); Kevin W. Smith, Hughesville, PA (US); Anthony J. Peachey, Muncy, PA (US); Timothy A. Fisher, Montoursville, PA (US); Harold Dale Mathias, Watsontown, PA (US); Justin Eugene Moon, Montgomery, PA (US); Gabriel Patrick Blasi, Montgomery, PA (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 15/834,243

(22) Filed: Dec. 7, 2017

(65) Prior Publication Data

US 2018/0100301 A1 Apr. 12, 2018

Related U.S. Application Data

(63) Continuation of application No. 14/513,354, filed on Oct. 14, 2014, now Pat. No. 9,869,084.

(51) Int. Cl.

| | |
|---|---|
| ***E04B 1/36*** | (2006.01) |
| ***E04H 9/02*** | (2006.01) |
| ***E04F 11/02*** | (2006.01) |

(52) U.S. Cl.

CPC ..... *E04B 1/36* (2013.01); *E04H 9/021* (2013.01); *E04F 11/02* (2013.01)

(58) Field of Classification Search

CPC . E04F 11/04; E04F 11/022; E04F 2011/0203; E04B 1/36; E04H 9/02

(Continued)

(56) References Cited

U.S. PATENT DOCUMENTS 1,419,834 A * 6/1922 Fellows ..... E04F 11/04 182/1

3,068,958 A 12/1962 McCann (Continued)

FOREIGN PATENT DOCUMENTS

GB 976069 11/1964

GB 2043801 A 10/1980

OTHER PUBLICATIONS

U.S. Appl. No. 14/513,354 (U.S. Pat. No. 9,869,084), filed Oct. 14, 2014 (Jan. 16, 2018).

(Continued)

*Primary Examiner* — Brian D Mattei

(74) *Attorney, Agent, or Firm* — Baker Botts L.L.P.

(57) ABSTRACT

A stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing.

17 Claims, 8 Drawing Sheets

(58) Field of Classification Search
USPC ..... 52/183
See application file for complete search history.

(56) References Cited

U.S. PATENT DOCUMENTS

| | | | | | |
|---|---|---|---|---|---|
| 3,299,590 | A * | 1/1967 | Carter | E04F 11/0255 | 182/97 |
| 3,590,851 | A | 7/1971 | Bogossian et al. | | |
| 3,805,464 | A * | 4/1974 | Hanson | E04F 11/022 | 52/190 |
| 4,121,393 | A * | 10/1978 | Renault | E02D 27/34 | 14/73.1 |
| 4,238,137 | A | 12/1980 | Furchak et al. | | |
| 4,320,549 | A * | 3/1982 | Greb | E01D 19/046 | 14/73.5 |
| 4,406,347 | A * | 9/1983 | Stathopoulos | E04F 11/0255 | 182/1 |
| 4,642,953 | A * | 2/1987 | DeGood | E04F 11/06 | 52/183 |
| 4,707,957 | A | 11/1987 | Shepherd | | |
| 4,713,917 | A * | 12/1987 | Buckle | E01D 19/041 | 248/565 |
| 5,373,670 | A * | 12/1994 | Sasaki | E04H 9/022 | 267/141.1 |
| 5,887,540 | A | 3/1999 | Krish, Jr. | | |
| 5,941,342 | A | 8/1999 | Lee | | |
| 6,385,918 | B1 * | 5/2002 | Robinson | F16F 1/40 | 52/167.8 |
| 6,415,891 | B1 * | 7/2002 | Hayman | E04F 11/00 | 182/178.1 |
| 8,640,826 | B1 | 2/2014 | Beilstein | | |
| 2005/0211502 | A1 | 9/2005 | LaBrash | | |
| 2008/0236065 | A1 * | 10/2008 | Conservano | E04F 11/022 | 52/185 |
| 2009/0300994 | A1 * | 12/2009 | Atkins, III | E04H 3/28 | 52/7 |
| 2010/0117312 | A1 | 5/2010 | Walkingshaw et al. | | |
| 2010/0293875 | A1 * | 11/2010 | Preston | E04F 11/022 | 52/183 |
| 2011/0265395 | A1 * | 11/2011 | Chen | E04H 9/02 | 52/79.1 |
| 2018/0051764 | A1 * | 2/2018 | Wake | C08K 3/22 | |

OTHER PUBLICATIONS

U.S. Appl. No. 15/078,378 (U.S. Pat. No. 9,758,981), filed Mar. 23, 2016 (Sep. 12, 2017).
U.S. Appl. No. 15/078,378, Aug. 9, 2017 Issue Fee Payment.
U.S. Appl. No. 15/078,378, Jun. 6, 2017 Notice of Allowance.
U.S. Appl. No. 15/078,378, May 22, 2017 Response to Non-Final Office Action.
U.S. Appl. No. 15/078,378, Mar. 3, 2017 Non-Final Office Action.
U.S. Appl. No. 14/513,354, Dec. 11, 2017 Issue Fee Payment.
U.S. Appl. No. 14/513,354, Oct. 31, 2017 Notice of Allowance.
U.S. Appl. No. 14/513,354, Oct. 19, 2017 Amendment and Request for Continued Examination (RCE).
U.S. Appl. No. 14/513,354, Jan. 16, 2017 Reply Brief Filed.
U.S. Appl. No. 14/513,354, Oct. 4, 2016 Appeal Brief Filed.
U.S. Appl. No. 14/513,354, Aug. 4, 2016 Notice of Appeal Filed.
U.S. Appl. No. 14/513,354, Jun. 6, 2016 Final Office Action.
U.S. Appl. No. 14/513,354, May 9, 2016 Response to Non-Final Office Action.
U.S. Appl. No. 14/513,354, Feb. 8, 2016 Non-Final Office Action.
U.S. Appl. No. 14/513,354, Jan. 15, 2016 Amendment and Request for Continued Examination (RCE).
U.S. Appl. No. 14/513,354, Dec. 4, 2015 Advisory Action.
U.S. Appl. No. 14/513,354, Nov. 20, 2015 Response after Final Action.
U.S. Appl. No. 14/513,354, Sep. 21, 2015 Final Office Action.
U.S. Appl. No. 14/513,354, Aug. 21, 2015 Response to Non-Final Office Action.
U.S. Appl. No. 14/513,354, May 21, 2015 Non-Final Office Action.
U.S. Appl. No. 14/513,354, Apr. 27, 2015 Response to Restriction Requirement.
U.S. Appl. No. 14/513,354, Mar. 6, 2015 Restriction Requirement.

* cited by examiner

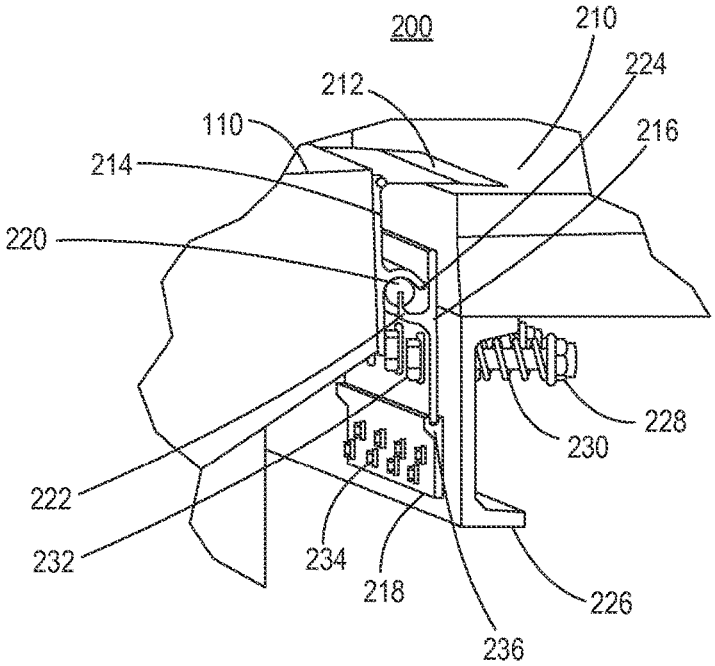
FIG. 6
FIG. 5
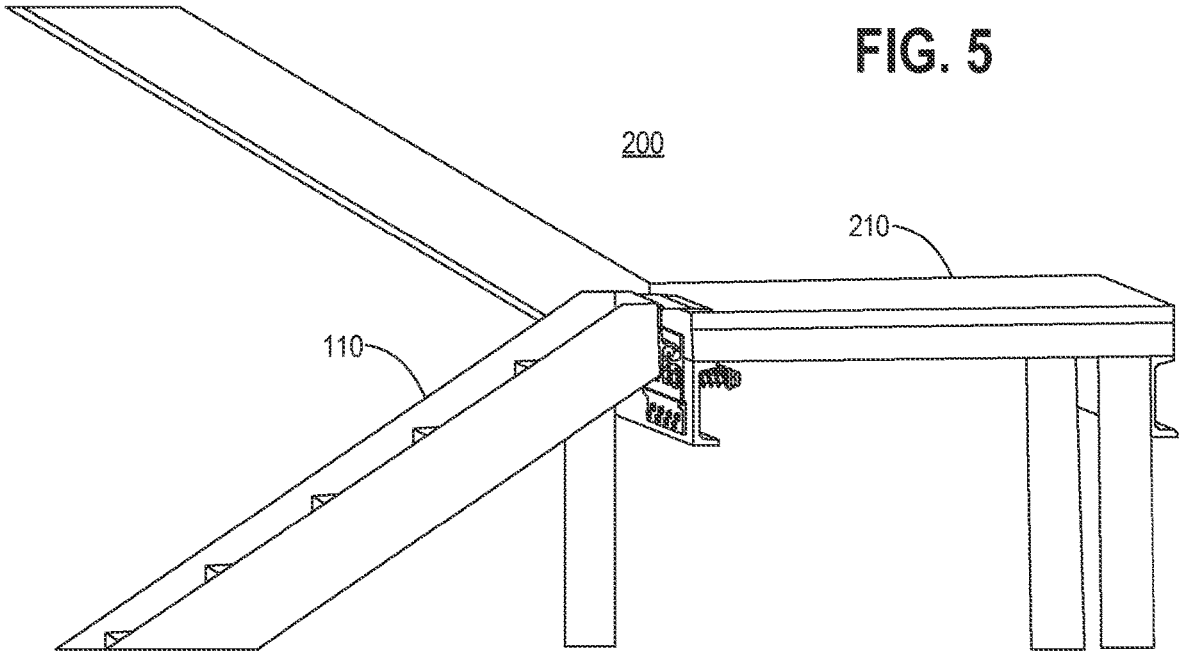

STAIR EXPANSION JOINT SYSTEM WITH FREEDOM OF MOVEMENT BETWEEN LANDINGS

CROSS REFERENCE TO RELATED APPLICATIONS

This application is a continuation of and claims priority to U.S. patent application Ser. No. 14/513,354 filed Oct. 14, 2014 and entitled "STAIR EXPANSION JOINT SYSTEM WITH FREEDOM OF MOVEMENT BETWEEN LANDINGS," the contents of which are incorporated by reference herein.

FIELD OF THE DISCLOSURE

The present disclosure relates generally to stairs. More particularly, the present disclosure relates to a stair expansion joint system with freedom of movement between landings.

BACKGROUND OF THE DISCLOSURE

Conventionally, installing stairs creates a rigid structure between landings or levels as the stairs are a rigid diagonal member that creates force between the levels. The force created by this rigid diagonal member must be accounted for in building design. Also, because of inter-story drift during seismic events, the rigid diagonal member created by the stairs causes damage to the surrounding structure and/or the stairs. Damage could result in structural damage and/or total collapse of the stairs eliminating a means of egress from the building during or after an event.

BRIEF SUMMARY OF THE DISCLOSURE

In an exemplary embodiment, a stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing. The landing can be a lower landing and the second landing can be an upper landing. The stair system can further include a second connection system configured to connect the stairs to the second landing, wherein the second connection system structurally supports the stairs for safe egress over the stairs while concurrently supporting movement between the landing and the second landing associated with the construction by the stairs in at least one dimension. The landing can be an upper landing and the second landing can be a lower landing.

The connection system can include at least two base isolators connected to the stairs and supported by the landing, wherein each of the at least two base isolators include a first bearing pad connected to the stairs, a second bearing pad support by the landing, and a flexible member between the first bearing pad and the second bearing pad. The flexible member can be an isolator spring or a rubber isolator, and wherein the at least two base isolators provide movement of the stairs in multiple directions relative to the landing. The connection system can include a hinged lateral slide mechanism between the stairs and the landing, the landing is an upper landing, wherein the hinged lateral slide mechanism prevents the stairs from rigid attachment to the upper landing. The hinged lateral slide mechanism can include a stair mount on the stairs coupled to a lateral slide on the upper landing via a connector; and a base mount fixed to the upper landing or an associated structure, wherein the base mount supports the lateral slide, and wherein the lateral slide is moveable relative to the upper landing or the associated structure and the stair mount is moveable relative to the lateral slide via the connector.

The connection system can include a precast stair slide system supported by a structure associated with the landing; and a tether system configured to connect a landing portion of the precast stair slide system to the landing in a moveable manner. The precast stair slide system can further include a plurality of bearing pads between the landing portion and the structure associated with the landing. The connection system can include a roller isolated assembly with a ball bearing base surface connected to the landing, a ball bearing support surface connected to the stairs, and a ball bearing between the ball bearing base surface and the ball bearing support surface, wherein the stairs are moveable relative to the landing about the ball bearing.

The connection system can include a sliding base assembly with a first plate connected to the stairs, a second plate connected to the landing, and a third plate between the first plate and the second plate, wherein the stairs are moveable relative to the landing based on the third plate. The first plate and the third plate can be high-density polyethylene and the second plate is metal. The connection system can include a stair pin system with a plurality of pistons connected to the landing and connected to the stairs via arms, wherein the stairs are moveable in one dimension based on movement of the pistons. The connection system can include a suspended stair assembly with attachments to a structure associated with the landing, the landing is an upper landing, and tethers to the stairs from the attachments, wherein the stairs are not fixedly attached to a lower landing.

In another exemplary embodiment, stairs with freedom of movement between landings associated therewith include a plurality of treads and rises; a support structure disposed to the plurality of treads and rises; an upper connector configured to support an upper portion of the support structure at an upper landing; and a lower connector configured to support a lower portion of the support structure at a lower landing; wherein at least one of the upper connector and the lower connector structurally supports the support structure for safe egress over the plurality of treads and rises while concurrently supporting movement between the landings by the support structure in at least one dimension, and wherein the movement supports inter-story drift between the landings and removes some force translation between the landings. The support structure can be fixedly connected to the upper landing and moveably connected to the lower landing. The support structure can be moveably connected to the upper landing and moveably connected to the lower landing. The support structure can be moveably connected to the upper landing and fixedly connected to the lower landing.

BRIEF DESCRIPTION OF THE DRAWINGS

The present disclosure is illustrated and described herein with reference to the various drawings, in which like reference numbers are used to denote like system components/method steps, as appropriate, and in which:

FIG. 5 is a perspective diagram of a hinged lateral slide stair system in an exemplary embodiment;

FIG. 6 is a magnified perspective diagram of a lateral slide joint for the hinged lateral slide stair system of FIG. 5 in an exemplary embodiment;

DETAILED DESCRIPTION OF THE DISCLOSURE

Figure 1:
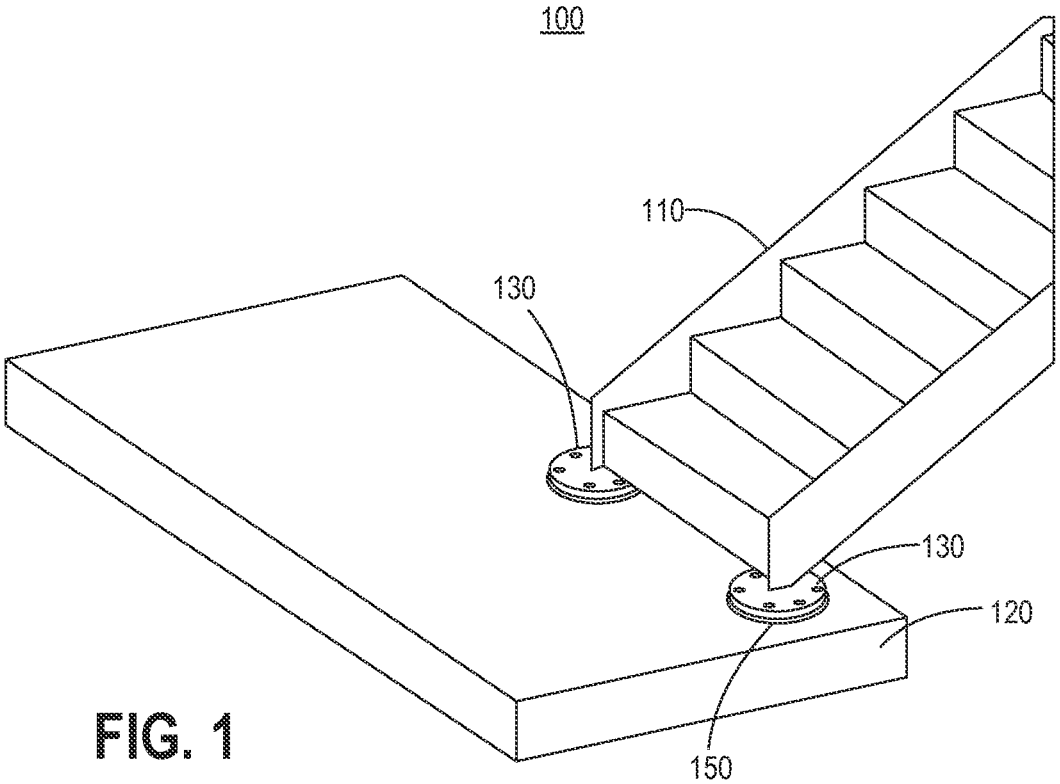
FIG. 1 is a perspective diagram of a base isolated stair system in an exemplary embodiment.

In various exemplary embodiments, a stair expansion joint system with freedom of movement between levels is described. Various types configurations are described for the stair expansion joint system to provide functioning connection points of the stair system allowing for movement between levels (inter-story drift) while concurrently maintaining structural integrity. These various stair expansion joint system designs allow for independent movement of the surrounding building walls, landings, floor slabs, or any portion of the surrounding building structure to the stair system(s). The designs include components to cover or fill the open space between stairs (expansion joint covers) and surrounding structure. Inclusive is a secondary device(s) capable of maintaining consistent spacing within the expansion joint spaces as well the ability to return the stairs near to its original location. The stair expansion joint system could as well be part of the mounting structure for securing the stairs to landings, surrounding building structures, or floor slabs.

The stair expansion joint system can be utilized in applications for new construction as well be used in the field of existing constructions for retrofit applications for the seismic movement between levels, landings or within the stairwell structure. The stair expansion joint system can include either metal and/or polymer materials or combination of by extruding shapes or through secondary manufacturing process. The stair expansion joint system can be partial or fully assembled in house or in the field. Providing such system(s) allow for differential movements between levels and within the stair well structure to reduce or eliminate damage during building movement whether it be from wind, thermal, seismic or combination. The stair expansion joint system allows for directional movement or combination of, tension and compression, lateral, or vertical movement.

In an exemplary embodiment, a stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing.

Optionally, the landing is a lower landing and the second landing is an upper landing. The stair system can further include a second connection system configured to connect the stairs to the second landing, wherein the second connection system structurally supports the stairs for safe egress over the stairs while concurrently supporting movement between the landing and the second landing associated with the construction by the stairs in at least one dimension. Alternatively, the landing is an upper landing and the second landing is a lower landing.

Figure 2:
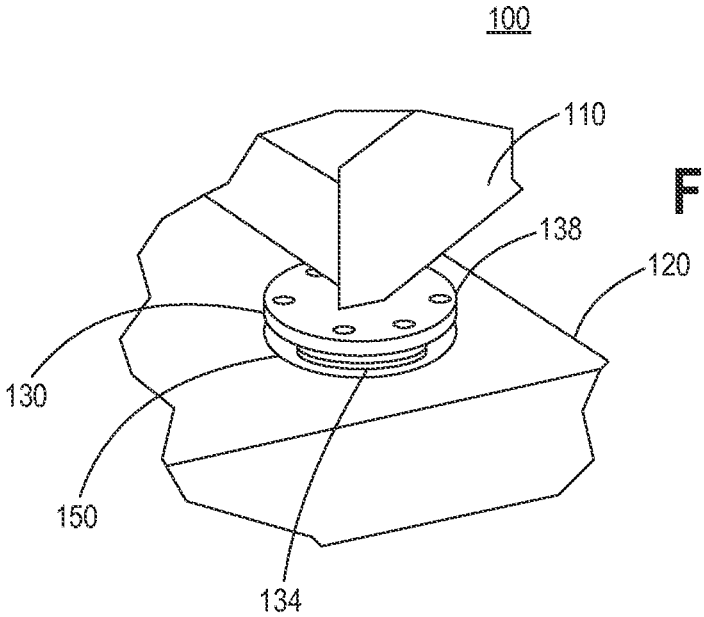
FIG. 2 is a magnified perspective diagram of the base isolated stair system of FIG. 1 illustrated a base isolator between stairs and a lower landing in an exemplary embodiment.
Figure 4:
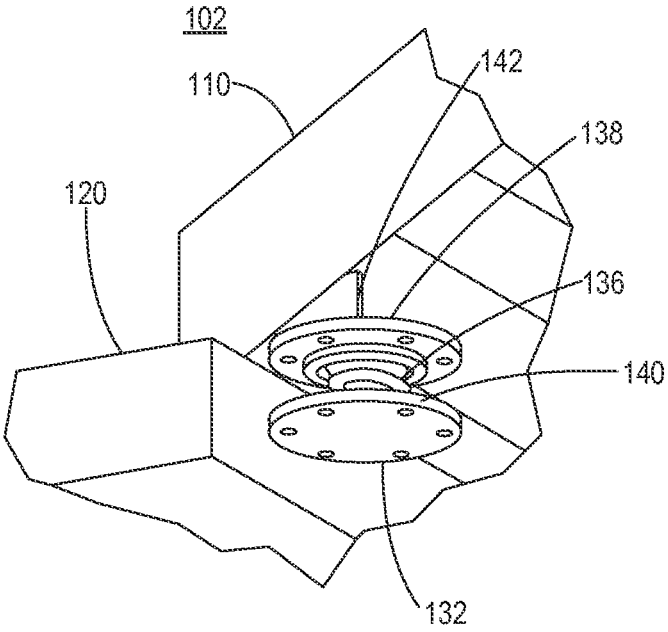
FIG. 4 is a magnified perspective diagram of the spring damper base isolated stair system of FIG. 3 illustrated a base isolator between stairs and a lower landing in an exemplary embodiment.
Figure 3:
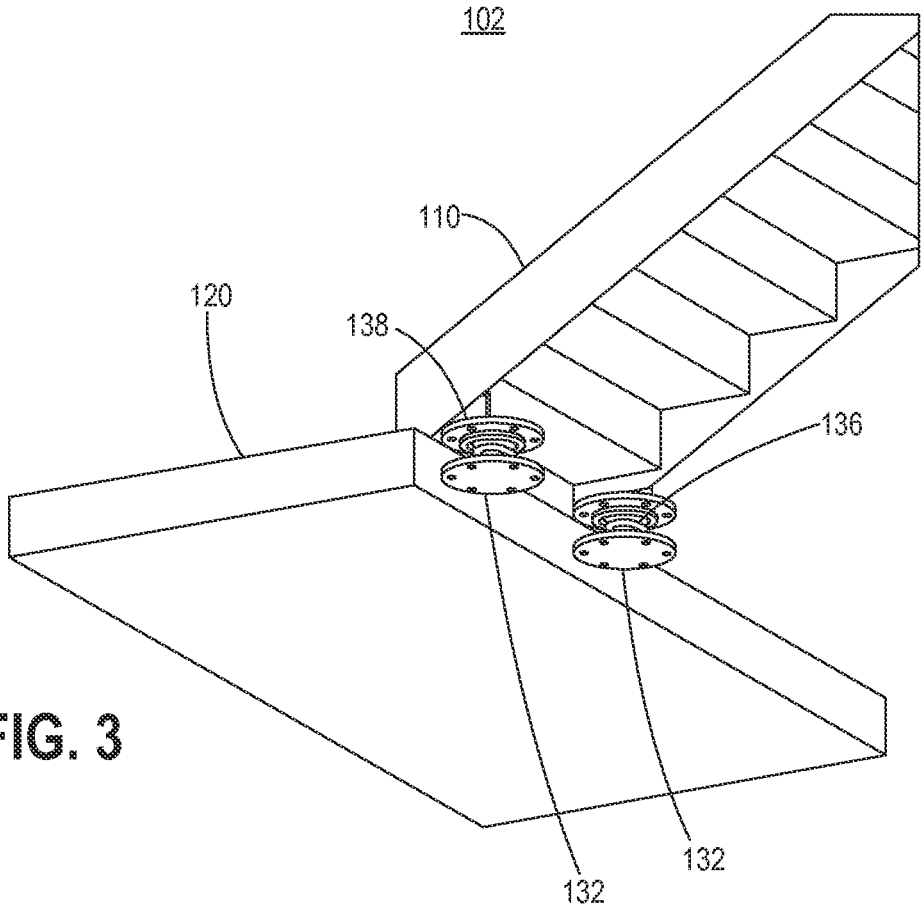
FIG. 3 is perspective diagram of a spring damper base isolated stair system in an exemplary embodiment.

Referring to FIGS. 1-4, in exemplary embodiments, perspective diagrams illustrate a stair system 100, 102. Specifically, the stair system 100, in FIGS. 1 and 2, is a base isolated system, and the stair system 102, in FIGS. 3 and 4, is a spring damper, base isolated system. The stair systems 100, 102 include stairs 110, including treads, risers, railings, etc., that are configured for multi-dimensional movement with a lower landing 120. That is, the stairs 110 are not fixedly attached to the lower landing 120. The stair systems 100, 102 include a base isolator 130, 132 between the stairs 110 and the lower landing 120. The base isolators 130, 132 utilize a similar design, with the base isolator 130 utilizing rubber isolators 134 and the base isolator 132 utilizing an isolator spring 136.

The base isolator 130, 132, illustrated in FIGS. 3 and 4 with the lower landing 120 cut away, include two bearing pads 138, 140 that are moveably attached to one another via the rubber isolators 134 for the base isolator 130 or via the isolator spring 136 for the base isolator 132. The bearing pads 138, 140 are illustrated in a circular structure, but other embodiments for the structure are contemplated. The bearing pad 138 is connected to the stairs 110. For the stair system 100, in FIG. 2, the bearing pad 138 is connected to a bottom of the stairs 110. For the stair system 102, in FIG. 3, the bearing pad 138 is connected to the stairs 110 via an angle mount 142. Of course, the stair system 102 can connect to the bottom of the stairs and the stair system 100 can use the angle mount 142. Other attachment mechanisms are also contemplated.

The base isolator 130, illustrated in FIGS. 1 and 2, is disposed within a well 150 in the lower landing 120. The well 150 is dimensioned and sized to receive the base isolator 130, 132. With the well 150, the base isolator 130, 132 can be fixedly connected to the lower landing 120, but movably disposed allowed for multi-dimensional movement of the stairs 110 relative to the lower landing 120. That is, the rubber isolators 134 and the isolator spring 136 enable Z-axis movement, and the well 150 enables movement in the X-Y plane. Thus, the force translated between the lower landing 120 and an upper landing (not shown) is minimized. Note, while the base isolators 130, 132 are illustrated disposed in the lower landing 120, the base isolators 130, 132 can also be connected at the upper landing.

With the stair systems 100, 102, the connection system includes at least two of the base isolators 130, 132 connected to the stairs 110 and supported by the landing 120, wherein each of the at least two base isolators 130, 132 include a first bearing pad connected to the stairs, a second bearing pad support by the landing, and a flexible member between the first bearing pad and the second bearing pad. Optionally, the flexible member is an isolator spring or a rubber isolator, and wherein the at least two base isolators provide movement of the stairs in multiple dimensions relative to the landing.

Referring to FIGS. 5 and 6, in an exemplary embodiment, perspective diagrams illustrate a hinged lateral slide stair system 200. The hinged lateral slide stair system 200 keeps the stairs 110 from being rigidly anchored to an upper landing 210, allowing for horizontal and/or lateral movement relative to the upper landing 210. The stairs 110, at the lower landing 120 (not shown in FIGS. 5 and 6) can be connected via any of the systems described herein or fixedly attached. The hinged lateral slide stair system 200 includes a landing plate 212, a stair mount 214, a lateral slide 216, and a base mount 218. The landing plate 212 can be hinged to the stair mount 214 and/or the stairs 110. The landing plate 212 is laid over the upper landing 210 to cover a gap between the stairs 110 and the upper landing 210 based on the construction of the hinged lateral slide stair system 200.

The stair mount 214 is connected to the stairs 110 and is configured to connect the stairs to the lateral slide 216 via a connector 220. In this exemplary embodiment, the connector 220 is a cylindrical structure that can be formed of suitable materials such as high-density polyethylene (HDPE) or the like. The connector 220 is fixedly connected to a flange structure 222 connected to or integrally formed in the lateral slide 216. The stair mount 214 includes a lip structure 224 that is placed over the connector 220. Collectively, the connector 220, the flange structure 222, and the lip structure 224 enable lateral and/or horizontal movement of the stairs 110 relative to the upper landing 210. The lip structure 224 can be secured over the connector to ensure the stairs 110 do not detach from the upper landing 210.

The lateral slide 216 is not fixedly attached to the upper landing 210. Specifically, the lateral slide 216 can be connected to a structure 226, such as an I-beam or the like, associated with the upper landing 210 with bolts 228 and springs 230. The bolts 228 can be connected to the structure 226 via nuts 232, and the springs 230 enable movement of the bolts 228 and the lateral slide 216. The base mount 218 is fixedly attached to the structure 226, such as via bolts 234. The base mount 218 includes a lip structure 236 which provides support for the lateral slide 216 in a vertical, Z-axis, orientation.

With the hinged lateral slide stair system 200, the connection system includes a hinged lateral slide mechanism between the stairs and the landing, the landing is an upper landing, wherein the hinged lateral slide mechanism prevents the stairs from rigid attachment to the upper landing. The hinged lateral slide mechanism can include a stair mount on the stairs coupled to a lateral slide on the upper landing via a connector; and a base mount fixed to the upper landing or an associated structure, wherein the base mount supports the lateral slide, and wherein the lateral slide is moveable relative to the upper landing or the associated structure and the stair mount is moveable relative to the lateral slide via the connector.

Figure 8:
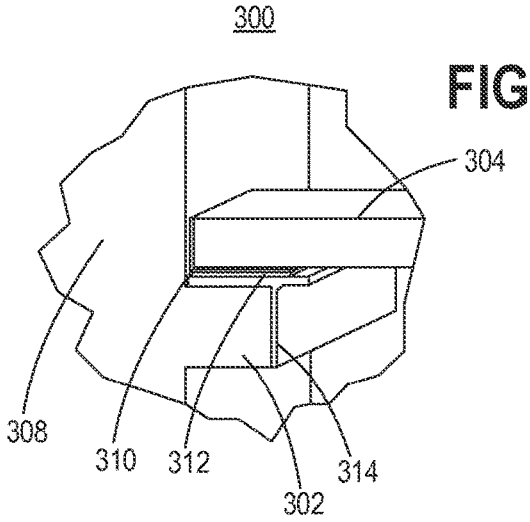
FIG. 8 is a magnified perspective diagram of the precast stair slide system of FIG. 7 illustrating bearings on a landing structure in an exemplary embodiment.
Figure 7:
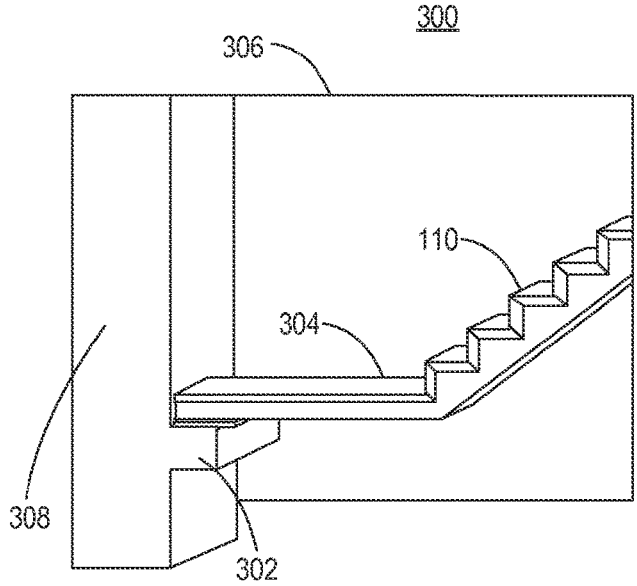
FIG. 7 is a side perspective diagram of a precast stair slide system in an exemplary embodiment.
Figure 9:
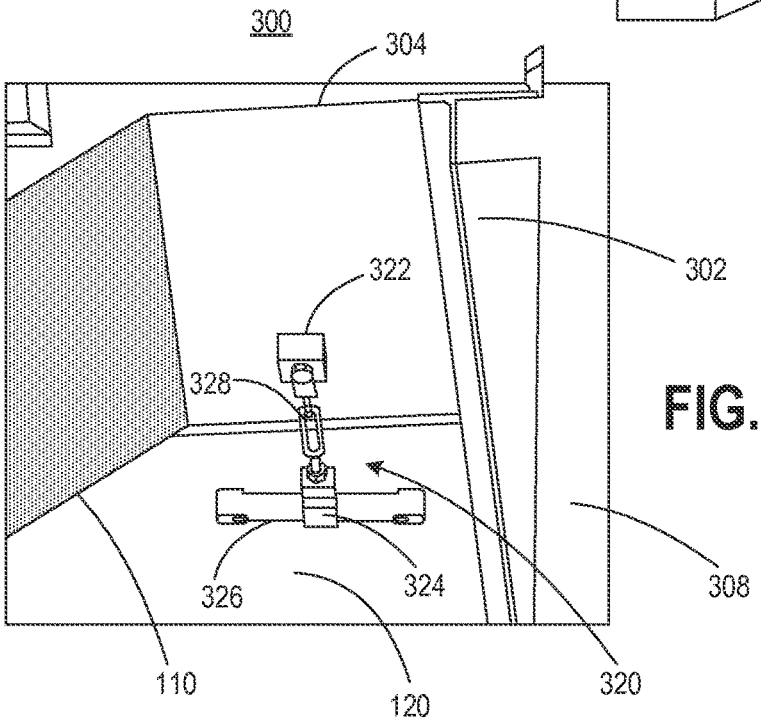
FIG. 9 is a perspective view underneath the precast stair slide system of FIG. 7 in an exemplary embodiment.

Referring to FIGS. 7, 8, and 9, in an exemplary embodiment, perspective diagrams illustrate a precast stair slide system 300. FIG. 7 is a side perspective diagram of the precast stair slide system 300, FIG. 8 is a magnified perspective diagram of the precast stair slide system 300 illustrating bearings on a landing structure 302, and FIG. 9 is a perspective view underneath the precast stair slide system 300. The precast stair slide system 300 includes the stairs 110 integrally formed with a landing portion 304. The landing portion 304 is located next to the lower landing 120 as shown in FIG. 9, and optionally next to a wall 306. The precast stair slide system 300, through the stairs 110, can be fixedly attached to the upper landing (not shown in FIGS. 7, 8, and 9).

The landing portion 304 is moveably supported by the landing structure 302, which is formed or connected to a fixed structure 308. The landing structure 302 extends from the fixed structure 308 to provide support for the landing portion 304. The precast stair slide system 300 includes a stair bearing pad 310, a high-density polyethylene bearing pad 312, and a landing structure bearing pad 314. The stair bearing pad 310 is between the landing portion 304 and the fixed structure 308 and between the landing portion 304 and the high-density polyethylene bearing pad 312. The landing structure bearing pad 314 is between the landing structure 302 and the high-density polyethylene bearing pad 312.

In FIG. 9, the precast stair slide system 300 includes a precast stair separator assembly 320 which is configured to moveably connect the precast stair slide system 300 to the landing portion 120. The precast stair slide system 300 is configured to float relative to the landing portion 120 based on the precast stair separator assembly 320. The precast stair separator assembly 320 includes a fixed connection 322 underneath the landing portion 304 and a moveable connector 324 connected to a fixed connection 326 underneath the lower landing 120. The moveable connector 324 is connected to the fixed connection 322 via a tether 328.

With the precast stair slide system 300, the connection system includes a precast stair slide system supported by a structure associated with the landing; and a tether system configured to connect a landing portion of the precast stair slide system to the landing in a moveable manner. The precast stair slide system can further include a plurality of bearing pads between the landing portion and the structure associated with the landing.

Figure 11:
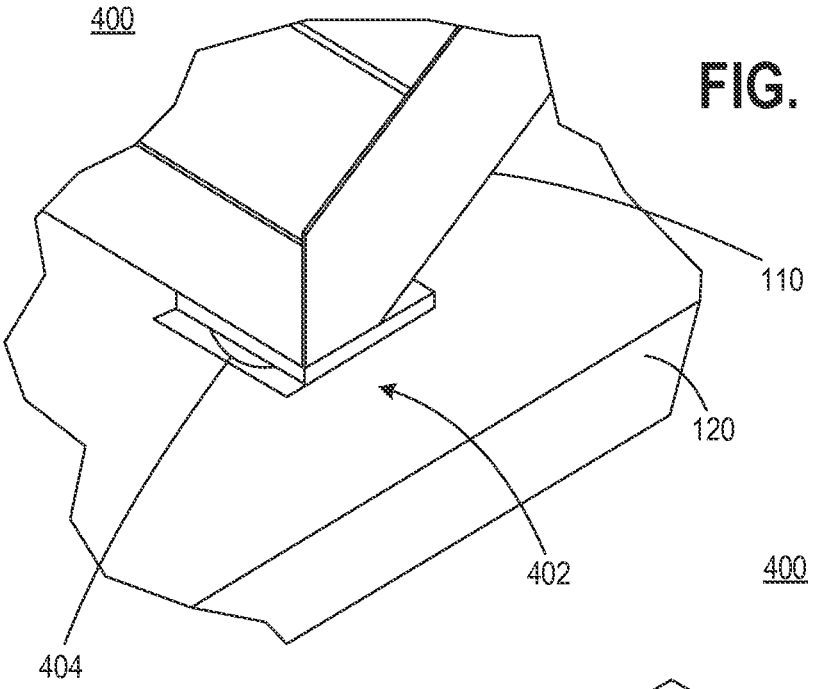
FIG. 11 is a magnified perspective diagram of a roller isolated assembly in the roller isolated stair system of FIG. 10.
Figure 10:
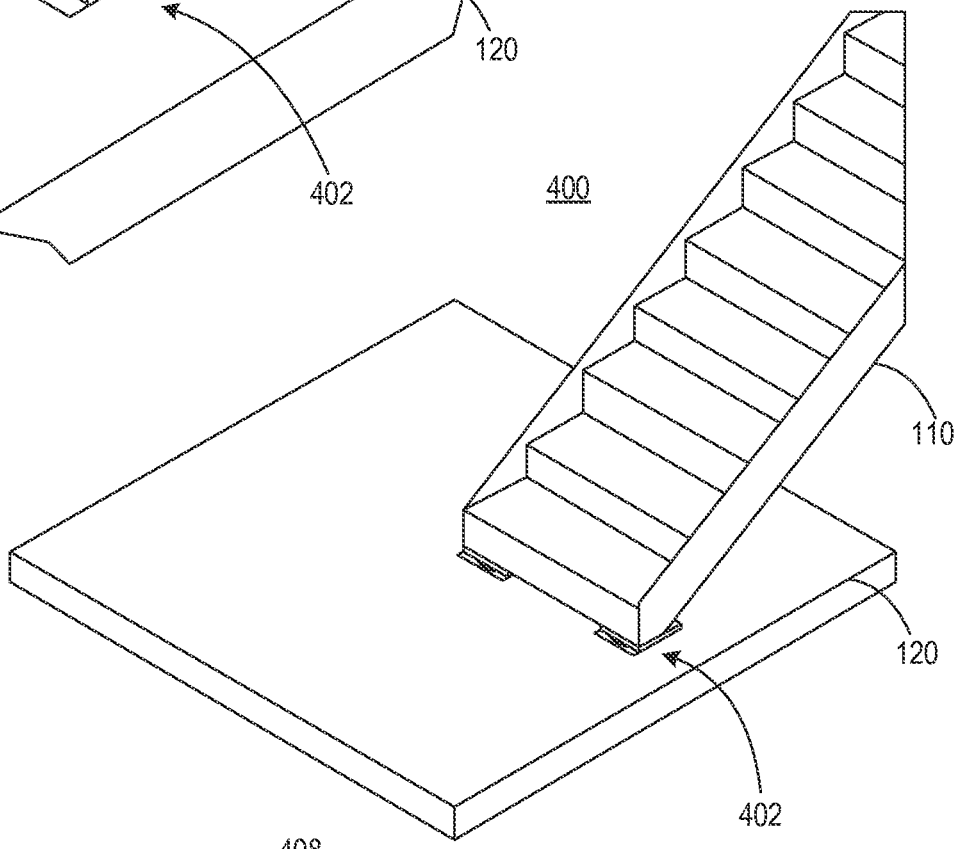
FIG. 10 is a perspective diagram of a roller isolated stair system in an exemplary embodiment.
Figure 12:
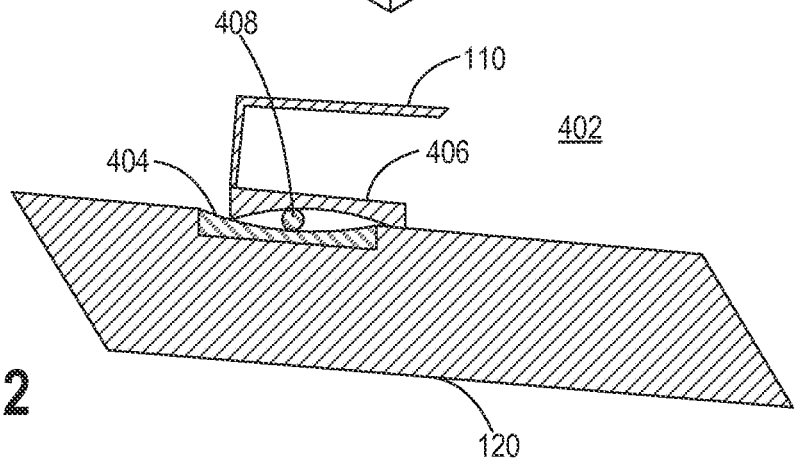
FIG. 12 is a cross-sectional diagram of the roller isolated assembly of FIG. 11 in an exemplary embodiment.

Referring to FIGS. 10, 11, and 12, in an exemplary embodiment, perspective diagrams illustrate a roller isolated stair system 400. FIG. 10 is a perspective diagram of the roller isolated stair system 400, FIG. 11 is a magnified perspective diagram of a roller isolated assembly 402, and FIG. 12 is a cross-sectional diagram of the roller isolated assembly 402. The roller isolated stair system 400 enables horizontal and vertical movement by the stairs 110 relative to the lower landing 120. Specifically, the roller isolated assembly 402 includes a ball bearing base surface 404 partially cast into the lower landing 120. The stairs 110 include a ball bearing support surface 406. A ball bearing 408 is included between the ball bearing base surface 404 and the ball bearing support surface 406. In this manner, the stairs 110 support movement based on engagement between the ball bearing support surface 406 and the ball bearing base surface 404 via the ball bearing 408.

With the roller isolated stair system 400, the connection system includes a roller isolated assembly with a ball bearing base surface connected to the landing, a ball bearing support surface connected to the stairs, and a ball bearing between the ball bearing base surface and the ball bearing support surface, wherein the stairs are moveable relative to the landing about the ball bearing.

Figure 14:
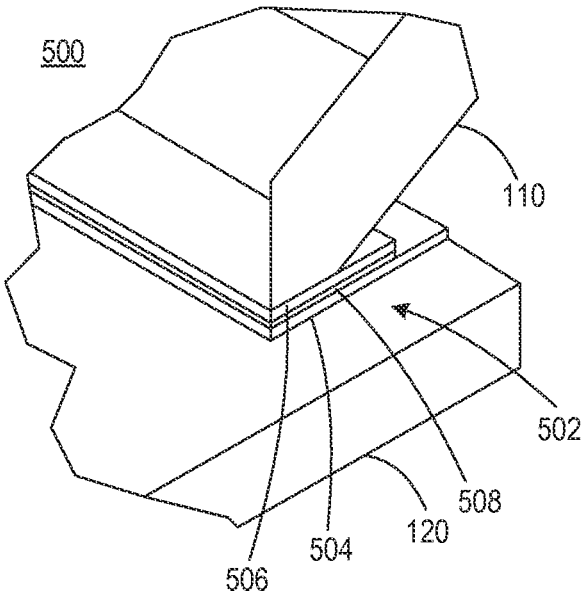
FIG. 14 is a magnified perspective diagram of a sliding base assembly in the sliding base stair system of FIG. 13 in an exemplary embodiment.
Figure 13:
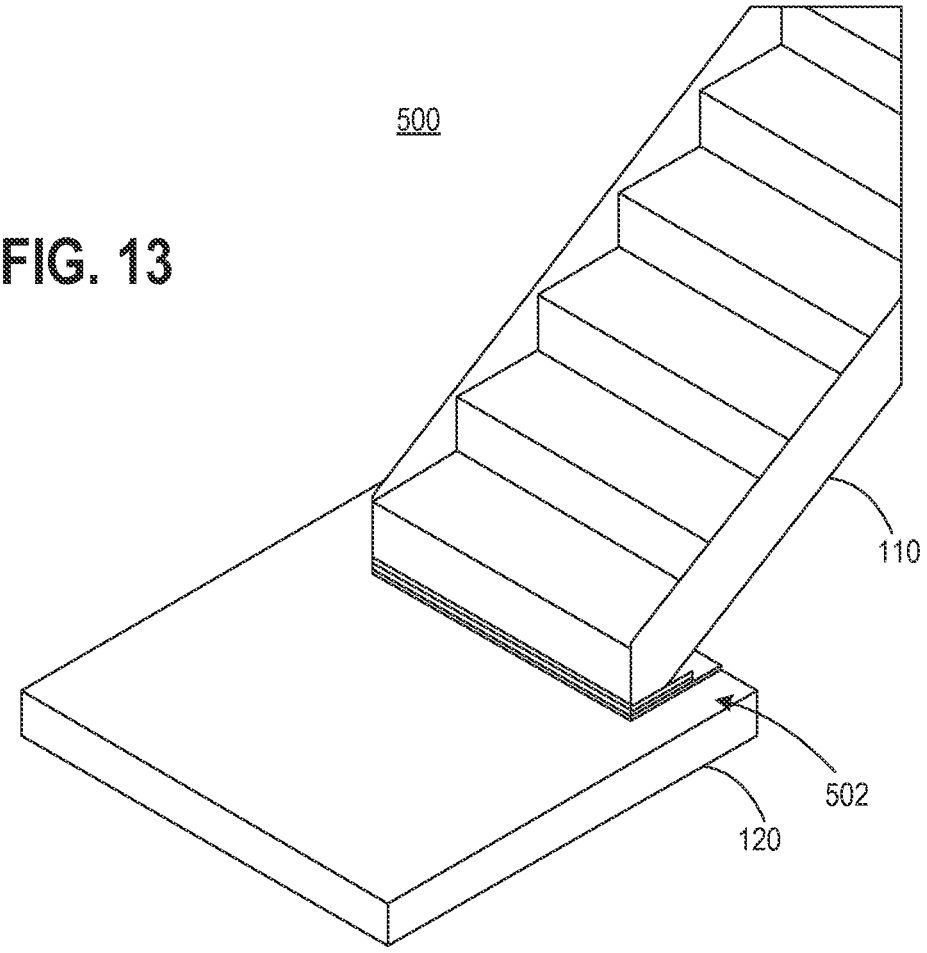
FIG. 13 is a perspective diagram of a sliding base stair system in an exemplary embodiment.

Referring to FIGS. 13 and 14, in an exemplary embodiment, perspective diagrams illustrate a sliding base stair system 500. FIG. 13 is a perspective diagram of the sliding base stair system 500, and FIG. 14 is a magnified perspective diagram of a sliding base assembly 502 in the sliding base stair system 500. The sliding base assembly 502 includes a high-density polyethylene plate 504 coupled to the lower landing 120 and a high-density polyethylene plate 506 disposed to the stairs 110. A metal plate 508 is disposed between the high-density polyethylene plate 504 and the high-density polyethylene plate 506. Accordingly, the stairs 110 support horizontal and/or vertical movement relative to the lower landing 120.

With the sliding base stair system 500, the connection system includes a sliding base assembly with a first plate connected to the stairs, a second plate connected to the landing, and a third plate between the first plate and the second plate, wherein the stairs are moveable relative to the landing based on the third plate. The first plate and the second plate can be high-density polyethylene and the third plate can be metal.

Figure 15:
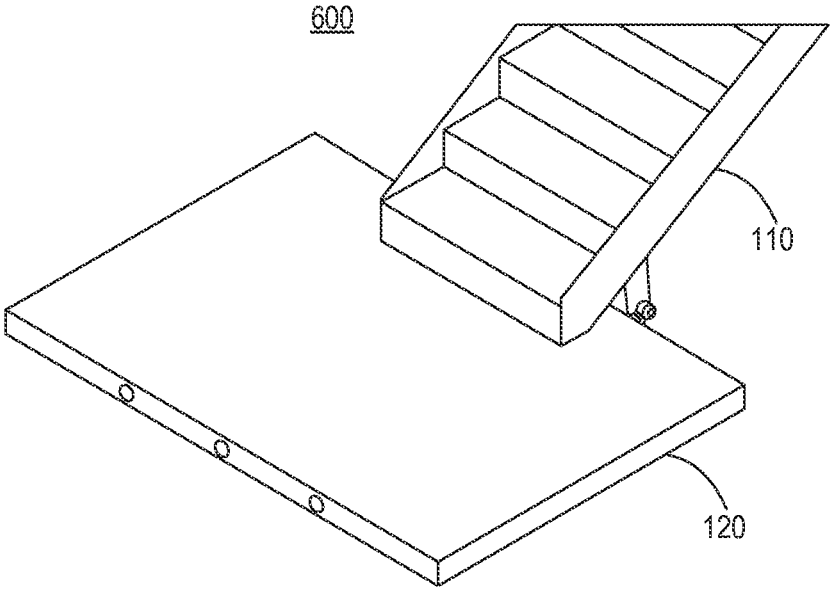
FIG. 15 is a perspective diagram of a stair pin system in an exemplary embodiment.
Figure 16:
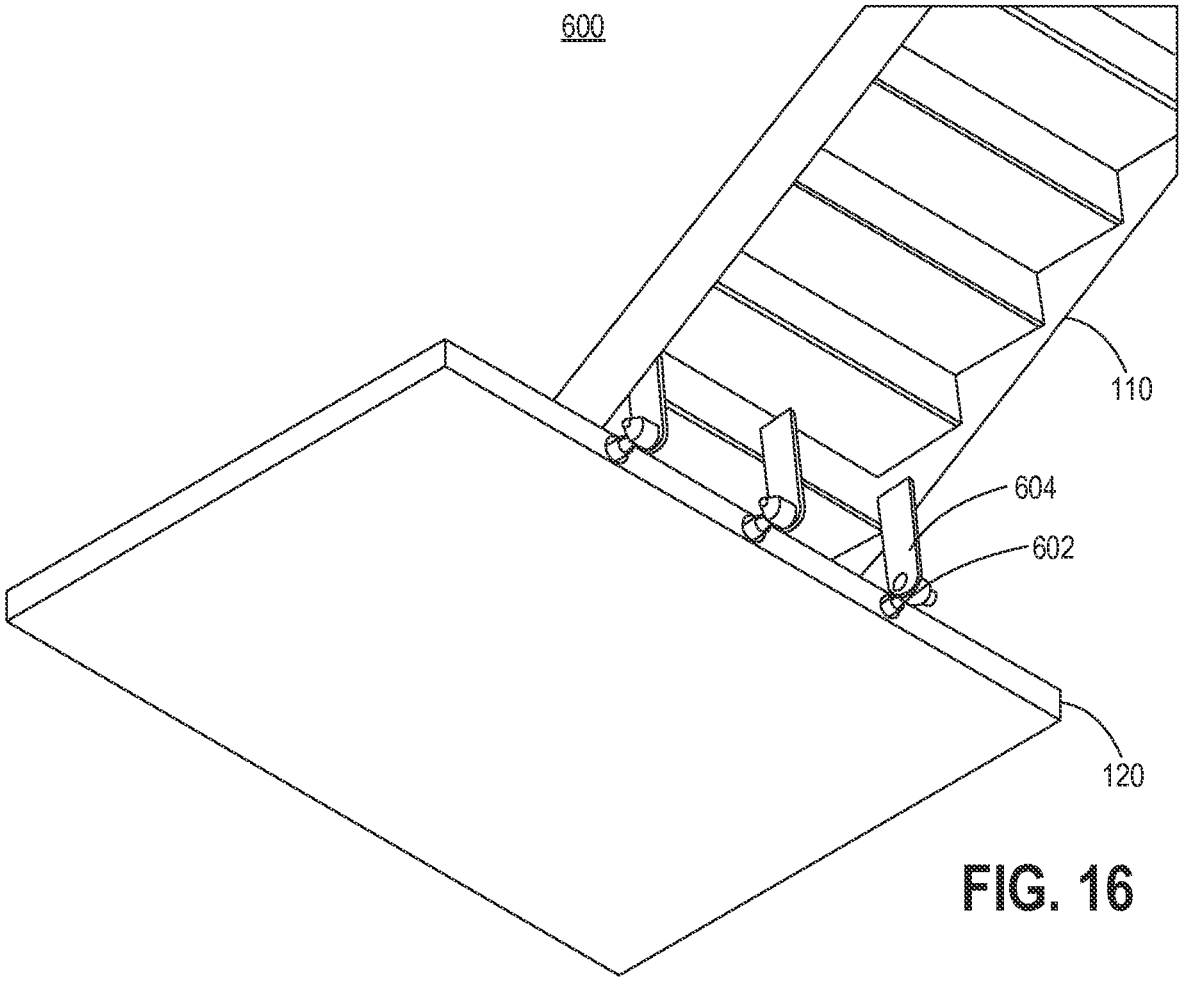
FIG. 16 is a perspective diagram underneath the stair pin system of FIG. 15 in an exemplary embodiment.

Referring to FIGS. 15 and 16, in an exemplary embodiment, perspective diagrams illustrate a stair pin system 600. FIG. 15 is a perspective diagram of the stair pin system 600, and FIG. 16 is a perspective diagram underneath the stair pin system 600. The stair pin system 600 includes pistons 602 disposed in the lower landing 120 and attached to under the stairs 110 via arms 604. The pistons 602 are configured to movement in and out of the lower landing 120 providing one-dimensional movement between the stairs 110 and the lower landing 120.

With the stair pin system 600, the connection system includes a stair pin system with a plurality of pistons connected to the landing and connected to the stairs via arms, wherein the stairs are moveable in one dimension based on movement of the pistons.

Figure 18:
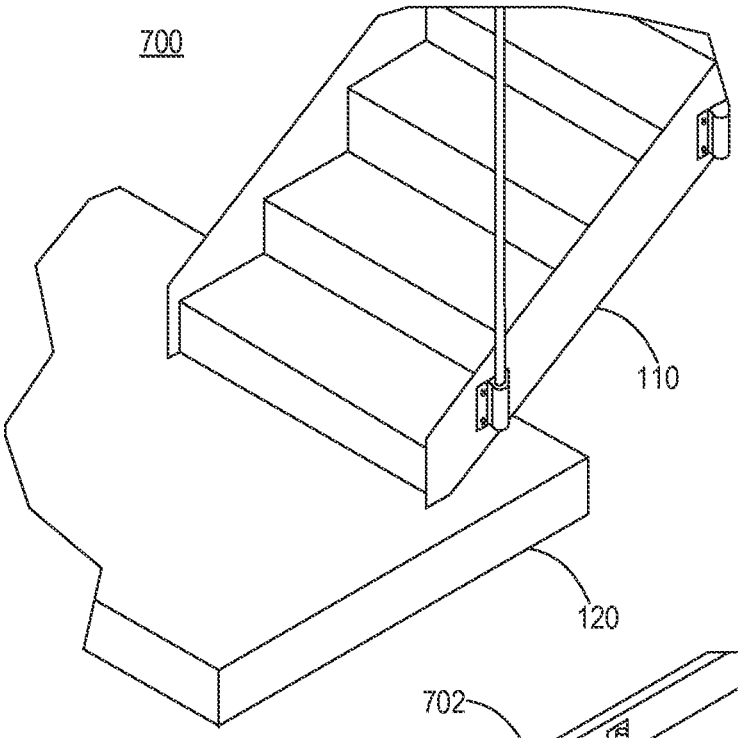
FIG. 18 is a magnified perspective diagram of the stairs and lower landing in the suspended stair system of FIG. 17 in an exemplary embodiment.
Figure 17:
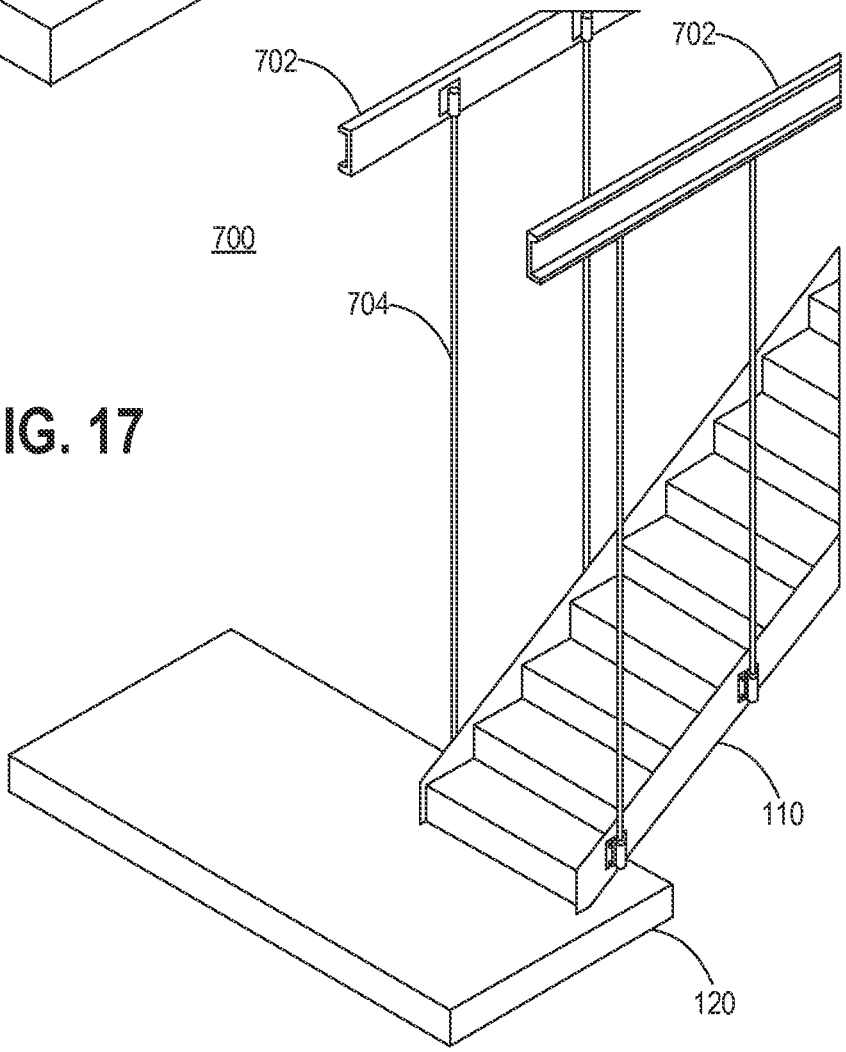
FIG. 17 is a perspective diagram of a suspended stair system in an exemplary embodiment.

Referring to FIGS. 17 and 18, in an exemplary embodiment, perspective diagrams illustrate a suspended stair system 700. FIG. 17 is a perspective diagram of the suspended stair system 700, and FIG. 18 is a magnified perspective diagram of the stairs 110 and lower landing 120 in the suspended stair system 700. The suspended stair system 700 is a hanging configuration where the stairs 110 are not fixedly attached to the lower landing 120. This takes the rigidity out of the stairs 110. The suspended stair system 700 includes fixed structural members 702 that are part of a construction, such as part of a floor associated with an upper landing (not shown). The stairs 110 are supported by tethers 704 that are fixedly attached to the fixed structural members 702 and the stairs 110.

With the suspended stair system 700, the connection system includes a suspended stair assembly with attachments to a structure associated with the landing, the landing is an upper landing, and tethers to the stairs from the attachments, wherein the stairs are not fixedly attached to a lower landing.

The various systems 100, 102, 200, 300, 400, 500, 600, 700 include a stair expansion joint system with freedom of movement between the landings 120, 210. The systems 100, 102, 200, 300, 400, 500, 600, 700 provide functioning connection points of between the stairs 110 and the lower landing 120 and/or the upper landing 210 allowing for movement between the landings 120, 210 (inter-story drift) while concurrently maintaining structural integrity of an associated construction (the landings 120, 210, the stairs 110, etc.). These various systems 100, 102, 200, 300, 400, 500, 600, 700 allow for independent movement of the surrounding building walls, landings, floor slabs, or any portion of the surrounding building structure to the various systems 100, 102, 200, 300, 400, 500, 600, 700. The designs include components to cover or fill the open space between the stairs 110 (expansion joint covers) and surrounding structures, the landings 120, 210. Inclusive is a secondary device(s) capable of maintaining consistent spacing within the expansion joint spaces as well the ability to return the stairs near to its original location. The systems 100, 200, 300, 400, 500, 600, 700 could as well be part of the mounting structure for securing the stairs 110 to landings 120, 210, surrounding building structures, or floor slabs.

The systems 100, 102, 200, 300, 400, 500, 600, 700 can be utilized in applications for new construction as well be used in the field of existing constructions for retrofit applications for the seismic movement between levels, landings or within the stairwell structure. The systems 100, 102, 200, 300, 400, 500, 600, 700 can include either metal and/or polymer materials or combination of by extruding shapes or through secondary manufacturing process. The systems 100, 102, 200, 300, 400, 500, 600, 700 can be partial or fully assembled in house or in the field. Providing such systems 100, 102, 200, 300, 400, 500, 600, 700 allow for differential movements between levels and within the stair well structure to reduce or eliminate damage during building movement whether it be from wind, thermal, seismic or combination. The systems 100, 102, 200, 300, 400, 500, 600, 700 allow for directional movement or combination of, tension and compression, lateral, or vertical movement.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A moveable stair system comprising:

a staircase having one or more stairs;

a first landing connection system disposed at a first end of the staircase;

a second landing connection system disposed at a second end of the staircase, wherein the first end is opposite the second end, wherein at least one of the first landing connection system and the second landing connection system is fixedly connected to a landing and is moveably disposed in each of an X-plane, a Y-plane, and a Z-plane to provide three degrees of freedom, and wherein the first member is at least partially and moveably disposed within a well of the landing; and wherein at least one of the first landing connection system and the second landing connection system includes a first member connected to a flexible member, wherein the flexible member is in contact with the landing.

2. The moveable stair system of claim 1, wherein the first landing connection system is an upper landing connection system and the second landing connection system is a lower landing connection system, wherein the first landing connection system is moveable in each of the X-plane, the Y-plane, and the Z-plane to provide three degrees of freedom.

3. The moveable stair system of claim 1, wherein the first landing connection system is a lower landing connection system and the second landing connection system is an upper landing connection system, wherein the first landing connection system is moveable in each of the X-plane, the Y-plane, and the Z-plane to provide three degrees of freedom.

4. The moveable stair system of claim 1, wherein each of the first landing connection system and the second landing connection system are moveable to provide three degrees of freedom, such that each of the first end and the second end of the staircase are moveable in each of the X-plane, the Y-plane, and the Z-plane.

5. The moveable stair system of claim 4, wherein the first landing connection system is an upper landing connection system and the second landing connection system is a lower landing connection system.

6. The moveable stair system of claim 4, wherein the first landing connection system is a lower landing connection system and the second landing connection system is an upper landing connection system.

7. The moveable stair system of claim 4, wherein each of the first landing connection system and the second landing connection system include at least one of a ball bearing, a plate, a roller, a slide mechanism, a hinge mechanism, a pin mechanism, a spring mechanism, a piston, and a cable.

8. The moveable stair system of claim 4, wherein the first landing connection system comprises a metal material or a polyethylene material and the second landing connection system comprises a metal material or a polyethylene material.

9. The moveable stair system of claim 1, further comprising a landing plate for covering a gap disposed between the staircase and a first landing.

10. The moveable stair system of claim 1, wherein the first landing connection system is an upper landing connection system and includes at least one of a ball bearing, a plate, a roller, a slide mechanism, a hinge mechanism, a pin mechanism, a spring mechanism, a piston, and a cable.

11. The moveable stair system of claim 1, wherein the first landing connection system is a lower landing connection system and includes at least one of a ball bearing, a plate, a roller, a slide mechanism, a hinge mechanism, a pin mechanism, a spring mechanism, a piston, and a cable.

12. The moveable stair system of claim 1, wherein the first landing connection system comprises at least one of a metal material and a polyethylene material.

13. An apparatus for supporting inter-story drift, comprising:

a first landing connection configured for connection with a staircase and a first landing, wherein the first landing connection is disposed at least partially between the staircase and the first landing;

wherein the first landing connection is moveable in each of an X-plane, a Y-plane, and a Z-plane to provide three degrees of freedom; and wherein the first landing connection system includes a first member connected to a flexible member, wherein the flexible member is in contact with the first landing, and wherein the first member is at least partially and moveably disposed within a well of a landing.

14. The apparatus of claim 13, wherein the first landing is an upper landing.

15. The apparatus of claim 13, wherein the first landing is a lower landing.

16. The apparatus of claim 13, wherein the first landing connection comprises a metal material or a polyethylene material.

17. A moveable stair system comprising:

a staircase having one or more stairs;

a first landing connection system disposed at a first end of the staircase; and a second landing connection system disposed at a second end of the staircase, wherein the first end is opposite the second end, and wherein at least one of the first landing connection system and the second landing connection system is moveable in each of an X-plane, a Y-plane, and a Z-plane to provide three degrees of freedom; and wherein at least one of the first landing connection system and the second landing connection system includes a first member connected to a flexible member, and wherein the first member is at least partially and moveably disposed within a well of a landing.

* * * * *